US006167616B1

(12) United States Patent
Shinchi

(10) Patent No.: US 6,167,616 B1
(45) **Date of Patent: *Jan. 2, 2001**

(54) CONNECTING METHOD OF ELECTRIC WIRE AND TERMINAL

(75) Inventor: Akira Shinchi, Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/098,466

(22) Filed: Jun. 17, 1998

(30) Foreign Application Priority Data

Jun. 19, 1997 (JP) ..... 9-162919

(51) Int. Cl.[7] ..... H01R 43/04

(52) U.S. Cl. ..... 29/861; 29/749; 29/859; 29/872; 174/92

(58) Field of Search ..... 29/857, 858, 861, 29/749, 859, 872; 174/92

(56) References Cited

U.S. PATENT DOCUMENTS

| | | | | |
|---|---|---|---|---|
| 3,440,118 | * | 4/1969 | Obeda | 156/73.2 |
| 4,730,764 | * | 3/1988 | Hawkins et al. | 228/1.1 |
| 4,922,072 | * | 5/1990 | Topel et al. | 219/56.1 |
| 5,057,661 | * | 10/1991 | Banner | 219/56.22 |
| 5,114,362 | * | 5/1992 | Olsson | 439/460 |
| 5,134,249 | * | 7/1992 | Adachi | 174/92 |
| 5,372,665 | * | 12/1994 | Chafin et al. | 156/73.1 |
| 5,584,122 | * | 12/1996 | Kato et al. | 29/872 |
| 5,857,259 | * | 1/1999 | Johnston | 29/858 |

FOREIGN PATENT DOCUMENTS

| | | |
|---|---|---|
| 197 57 349 | 7/1998 | (DE) . |
| 198 26 925 | 1/1999 | (DE) . |
| 7-70345 | 7/1995 | (JP) . |
| WO 94/25970 | * 11 1994 | (WO) . |

* cited by examiner

*Primary Examiner*—Carl J. Arbes
(74) *Attorney, Agent, or Firm*—Finnegan, Henderson Farabow, Garrett & Dunner, L.L.P.

(57) ABSTRACT

A connection method is proceeded by: placing a covered electric wire (18) on a terminal (17); applying an ultrasonic vibration in a state of pressing the covered electric wire (18) against the terminal (17) so as to melt and remove a covering portion (26); arranging a plurality of core wires on the terminal (17) in parallel; and pressing the arranged core wires (25) against the terminal (17) so that the core wires (25) and the terminal (17) conductively contact with each other.

3 Claims, 9 Drawing Sheets

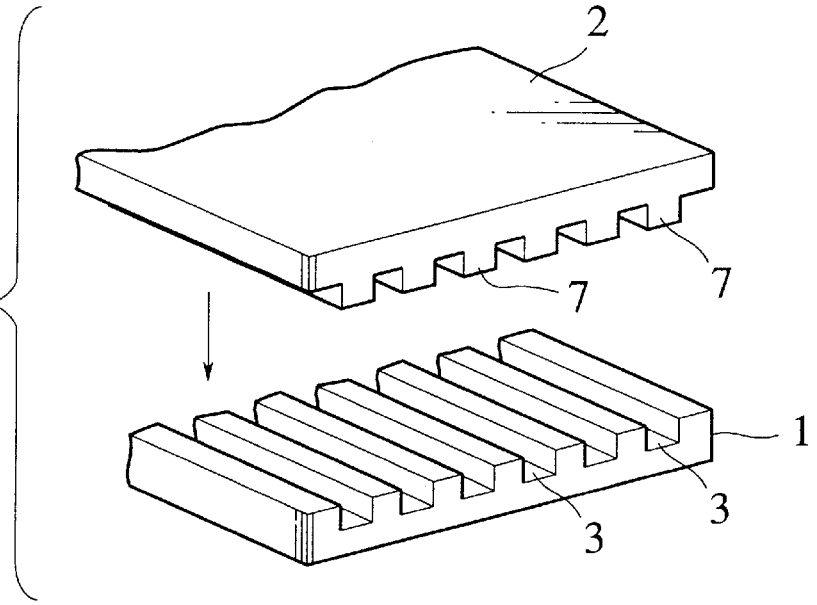
FIG.3
PRIOR ART
FIG.4
PRIOR ART
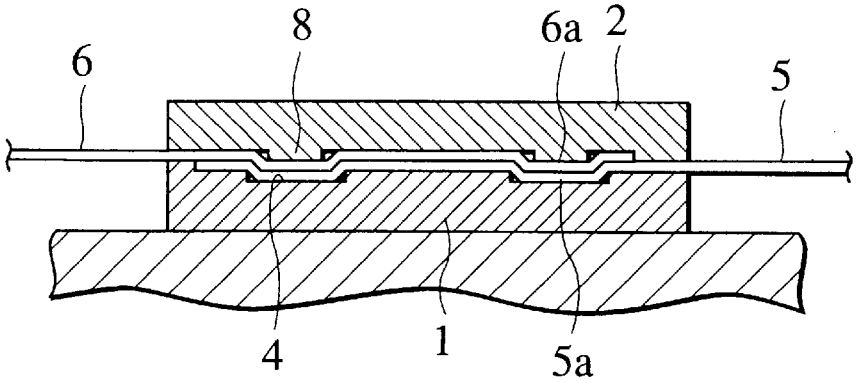

CONNECTING METHOD OF ELECTRIC WIRE AND TERMINAL

BACKGROUND OF THE INVENTION

1. Field of the Invention

The present invention relates to a connecting method of connecting an electric wire and a terminal by applying an ultrasonic vibration.

2. Description of the Related Arts

Japanese Patent Application Laid-Open No. 7-70345 discloses a connection structure in which a covering portion of a covered electric wire is melted (molten) and removed by applying an ultrasonic vibration so as to conductively connect a core wire of the covered electric wire and a terminal.

FIG. 1A and FIG. 1B each show a connector having a conventional structure in which a first member 1 and a second member 2 made of a resin face each other.

An upper surface of the first member 1 is formed with a groove portion 3 along a longitudinal direction thereof, and a small concave portion 4 is formed along a longitudinal direction of the groove portion 3 with a given interval. A terminal 5 is inserted into the groove portion 3 of the first member 1 along a longitudinal direction of the groove, and then, a covered electric wire 6 is placed on the terminal 5. The covered electric wire 6 is placed on the terminal 5 in a state that many core wires are covered with a covering portion made of a resin.

A lower surface of the second member 2 is formed with a protrusion 7 which is fitted into the groove portion 3 of the first member 1 and a small convex portion 8 which is fitted into the concave portion 4 of the groove 3, along the longitudinal direction thereof.

These members having the aforesaid structure are assembled in the following manner. More specifically, the terminal 5 and the covered electric wire 6 are inserted into the groove portion 3 of the first member 1, and then, in this state, the protrusion 7 of the second member 2 is fitted into the groove portion 3 of the first member 1 so that the terminal 5 and the covered electric wire 6 are pressed down by means of the second member 2 and the first member 1. At this time, the terminal 5 and the covered electric wire 6 are partially bent at a place where the concave portion 4 and the convex portion 8 are mutually fitted, so that these terminal and covered electric wire can be prevented from coming off.

And then, in a state that these terminal 5 and covered electric wire 6 are held between the first member 1 and the second member 2, an ultrasonic vibration is applied to these members from an ultrasonic horn (not shown) while pressing them. A covering portion of the covered electric wire 6 is melted and removed by a heat generated by the ultrasonic vibration, and therefore, an internal core wire is exposed, and thus, the exposed core wire and the terminal 5 conductively contact with each other. With this conductive contact, the first member 1 and the second member 2 are integrally connected, so that a connector housed the terminal 5 and the electric wire can be prepared.

FIG. 2 shows an example converse to FIG. 1A and FIG. 1B. More specifically, a small convex portion 8 is formed in the groove portion 3 of the first member 1, and a small concave portion 4 fitted into the convex portion 8 is formed in the second member 2. Likewise, in this case, in the state that the terminal 5 and the covered electric wire 6 are held between the first member 1 and the second member 2, by applying the ultrasonic vibration thereto, it is possible to conductively contact the core wire with the terminal 5.

FIG. 3 shows a structure for preparing a multi-polar connector, and the first member 1 is formed with a plurality of groove portions 3; on the other hand, the second member 2 is formed with a plurality of protrusions 7 which face the groove portions 3. After the terminal is housed in the respective groove portions 3, the covered electric wire is placed on the terminal, and thereafter, in a state that these terminal and electric wire are held between the first member 1 and the second member 2, the ultrasonic vibration is applied to them while pressing the same, thereby a connector being made.

FIG. 4 shows a state that the terminal 5 and the covered electric wire 6 are held between the first member 1 and the second member 2 having the structure as described above. And then, these terminal 5 and the covered electric wire 6 are pressed down by the protrusion of the second member 2 so as to be overlapped each other, and thus, bent portions 5*a* and 6*a* corresponding to the convex portion 8 and the concave portion 4 are formed to prevent these terminal and covered electric wire from coming off.

However, according to the conventional structure, the core wire of the covered electric wire does not sufficiently contact with the terminal; for this reason, the conventional structure has a problem that a contact resistance becomes large. FIG. 5 shows an ideal state that a core wire 9 of the covered electric wire and the terminal 5 contact with each other by the ultrasonic vibration. More specifically, the covering portion of the covered electric wire is melted and removed, and then, the core wires 9 are exposed and contact with the terminal 5 in a state of coming into line. Further, the exposed core wires 9 are held down by the protrusion 7 of the second member 2 so as to keep this contact state.

In actual fact, the protrusion 7 is softened by a heat generated when the covering portion of the covered electric wire is melted; as a result, as shown in FIG. 6, a distal end portion 7*a* of the protrusion 7 is formed. By the deformation of the protrusion 7, it is impossible to hold down the core wires 9, and the core wires 9 come loose in a row; for this reason, these core wires 9 can not sufficiently contact with the terminal 5. As a result, a contact area is reduced, and a contact resistance becomes large.

In such a case, there is made a proposal of forming the second member 2 including the protrusion 7 of a resin having high heat-resistance. However, the high heat-resistant resin is expensive, and it is difficult to mold the resin; for this reason, a precision is lowered. Further, the melted covering portion of the covered electric wire and the second member 2 are not effectively joined together; for this reason, there is a problem that these members are not firmly assembled.

SUMMARY OF THE INVENTION

The present invention has been achieved with such points in mind.

It therefore is an object of the present invention to provide a connecting method of connecting an electric wire and a terminal, which can arrange a plurality of core wires of a covered electric wire on a terminal so as to come into line, and can make a preferable contact between the core wires and the terminal, thereby reducing a contact resistance.

To achieve the object, according to a first aspect of the present invention, there is provided a connecting method of an electric wire and a terminal, comprising the steps of: placing a covered electric wire having a plurality of core wires covered with a covering portion made of a resin, on a terminal; applying an ultrasonic vibration or an ultrasonic wave oscillation to the covered electric wire in a state of pressing the covered electric wire against the terminal so as to melt and remove the covering portion so that the plurality of core wires are arranged on the terminal in parallel; and pressing the parallelly arranged core wires against the terminal so that the core wires and the terminal conductively contact with each other.

According to the connecting method of an electric wire and a terminal, the covered electric wire is placed on the terminal, and thereafter, the ultrasonic vibration or the ultrasonic wave oscillation is applied in a state of pressing the covered electric wire against the terminal. In this case, the pressing means includes, for example, an ultrasonic vibration applying horn, and other pressing members. When applying the ultrasonic vibration in a state of pressing the covered electric wire against the terminal, the covering portion of the covered electric wire is melted and removed, and then, by pressing, the core wires are arranged on the terminal in parallel. In this state, the core wires are pressed against the terminal so that the core wires and the terminal conductively contact with each other.

According to the connecting method of the present invention, the core wires are arranged on the terminal in parallel by pressing when melting and removing the covering portion of the covered electric wire by the ultrasonic vibration, and the core wires thus arranged are pressed against the terminal so that the core wires and the terminal conductively contact with each other. Therefore, a preferable connection between the core wires and the terminal can be obtained, and also, a contact resistance can be reduced.

According to a second aspect of the present invention, as it depends from the first aspect, wherein the terminal and the covered electric wire are housed in the groove portion of a first resin member in a state that they overlap each other; the ultrasonic vibration is applied in a state of pressing the covered electric wire against the terminal by means of an ultrasonic vibration applying horn; and the protrusion of a second resin member is inserted into the groove portion so as to press the core wires against the terminal.

According to the connecting method of the present invention, the covered electric wire is overlapped on the terminal in the groove portion of the first resin member, and in this state, when applying an ultrasonic vibration to these covered electric wire and terminal while pressing them by means of the ultrasonic vibration applying horn, the covering portion of the covered electric wire is melted and removed, and then, the core wires are arranged on the terminal in parallel by pressing from the horn. In this state, the protrusion of the second resin member is inserted into the groove portion so as to press the core wires against the terminal.

Accordingly, in the present invention, the core wires are arranged on the terminal in parallel by pressing when melting and removing the covering portion of the covered electric wire by the ultrasonic vibration, and the core wire thus arranged are pressed against the terminal by inserting the protrusion into the groove portion, and thereby the core wires and the terminal conductively contact with each other. Therefore, a preferable connection between the core wires and the terminal can be obtained, and also, a contact resistance can be reduced.

Further, the core wire and the terminal conductively contact with each other by applying the ultrasonic vibration and pressure to them from the ultrasonic horn, and thereafter, the protrusion of the second resin member presses the core wire against the terminal, so that the core wire can be prevented from coming loose without the protrusion being softened by the ultrasonic vibration. Therefore, it is possible to improve reliability in a connection between the core wire and the terminal.

According to a third aspect of the present invention, as it depends from the second aspect, wherein the first resin member and the second resin member are welded together in a state that the protrusion of the second resin member is inserted into the groove portion of the first resin member.

According to the connecting method of an electric wire and a terminal, the terminal and the covered electric wire are overlapped in the groove portion of the first resin member, and ultrasonic vibration is applied to them while pressing the same. By doing so, the covering portion of the covered electric wire is melted and removed, and the core wires and the terminal conductively contact with each other, and further, the core wires are arranged on the terminal in a parallel. In this state, the protrusion of the second resin member is inserted into the groove portion so that the core wires are arranged in parallel on the terminal. And then, the first resin member and the second resin member are coupled with each other by ultrasonic welding, and thereby, it is possible to easily meltedly join the first resin member and the second resin member together.

According to a fourth aspect of the present invention, as it depends from the second aspect, wherein the first resin member is mechanically or geometrically engaged with the second resin member in a state that the protrusion of the second resin member is inserted into the groove portion of the first resin member while being pressed; and the ultrasonic vibration is applied in the state.

According to the connecting method of an electric wire and a terminal, the terminal and the electric wire are housed in the groove portion of one resin member in a state of being overlapped each other, and the protrusion of another resin member is inserted into the groove portion. And then, an ultrasonic vibration is applied in a state of pressing these terminal and electric wire. At this time, the ultrasonic vibration is applied in a range such that the covering portion overlapped with the terminal is melted and removed without welding the first resin member and the second resin member together. In this case, the first resin member and the second resin member are mechanically formed, and thereby, the covered electric wire is pressed against the terminal.

Accordingly, the first resin member and the second resin member are mechanically or geometrically coupled with each other; therefore, it is possible to disengage the first resin member from the second resin member without causing breakage in maintenance. As a result, the first resin member and the second resin member can be repeatedly use.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIG. 3 is a perspective view showing a conventional multi-polar connector;

FIG. 4 is a cross-sectional view showing a conventional connection;

FIG. 9A is a cross-sectional view showing a manner of inserting the ultrasonic applying horn into a groove portion in a state that the terminal and the covered electric wire overlap each other in the groove portion;

FIG. 9B is a cross-sectional view showing a state of applying an ultrasonic vibration to the terminal and the covered electric wire overlapped in the groove portion;

FIG. 9C is a cross-sectional view showing a state that a covering portion of the covered electric wire is melted and removed by applying the ultrasonic vibration, and the core wires are arranged on the terminal so as to come into line;

FIG. 9D is a cross-sectional view showing a state that the core wires, which are arranged on the terminal so as to come into line, is pressed by a protrusion of the cover;

FIG. 12A is a cross-sectional view showing a state before a stopper protrusion is inserted into a hole;

Figure 12A:
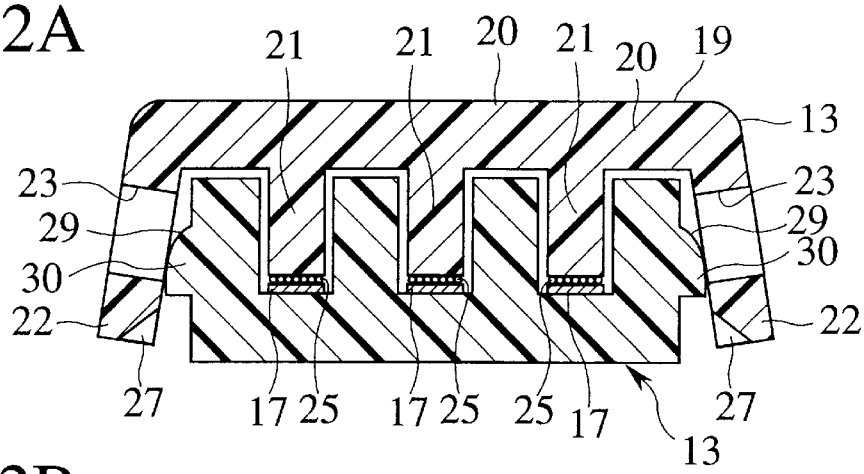
FIG. 12A and FIG. 12B show a connective relationship between a wire leading portion and the cover in one embodiment.
Figure 12B:
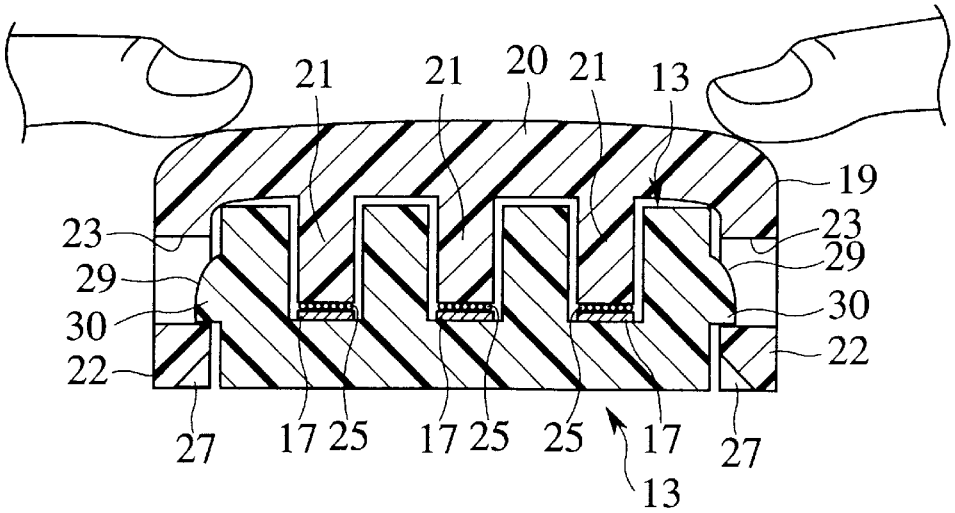
Figure 13:
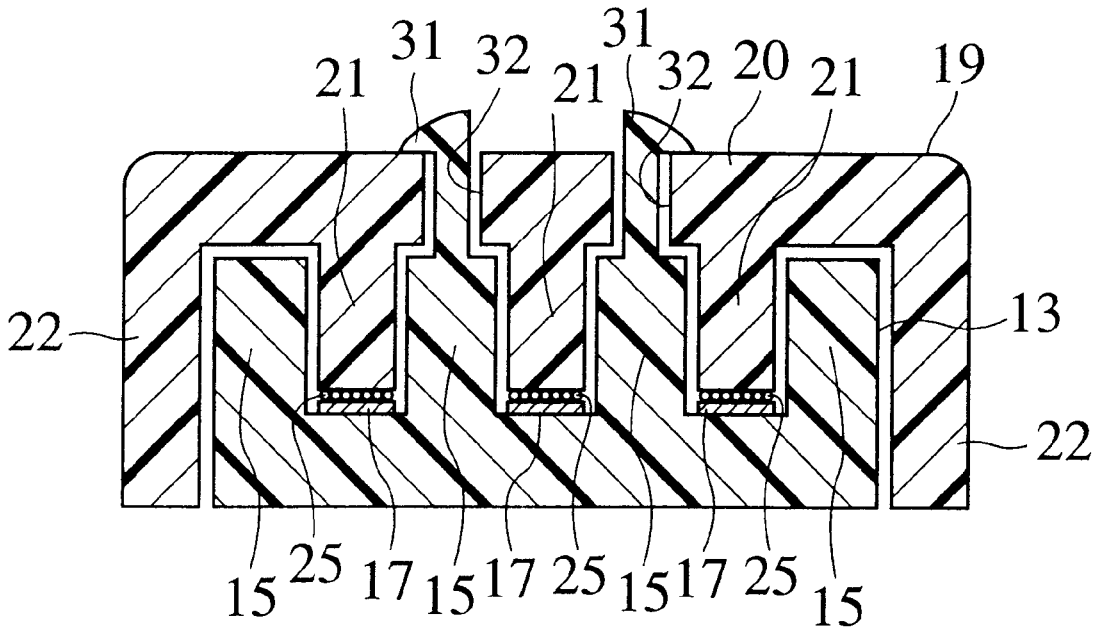

FIG. 12B being a cross-sectional view showing a state before a stopper protrusion is inserted into a hole; and FIG. 13 is a cross-sectional view showing a modified example of the connector housing and the cover in one embodiment.

DETAILED DESCRIPTION OF THE PREFERRED EMBODIMENTS

The contents of U.S. Pat. No. 5,584,122 are incorporated herein by reference.

There will be detailed below the preferred embodiments of the present invention with reference to the accompanying drawings. Like members are designated by like reference characters.

Figure 1A:
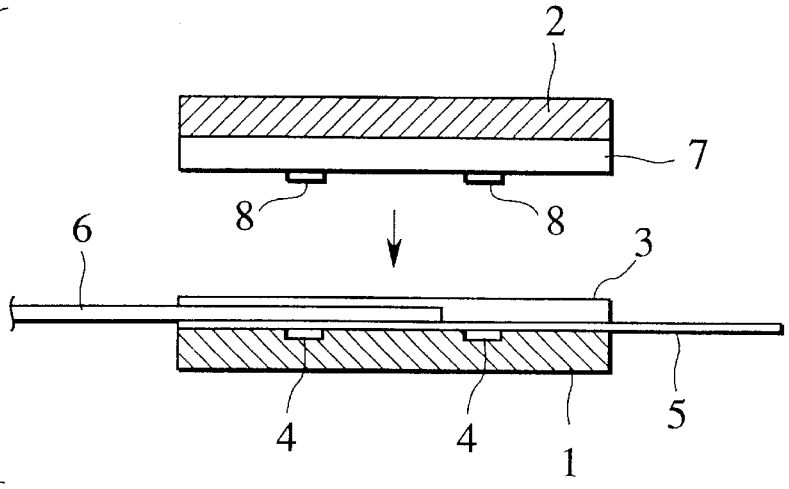
FIG.1A PRIOR ART
FIG. 1A is a cross-sectional view showing a conventional connection structure.
Figure 1B:
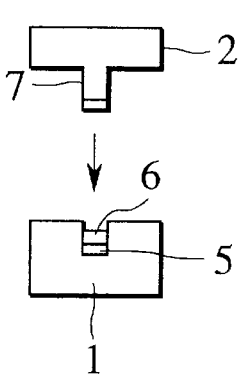
FIG.1B PRIOR ART
FIG. 1B is a front view of the conventional connection structure.
Figure 2:
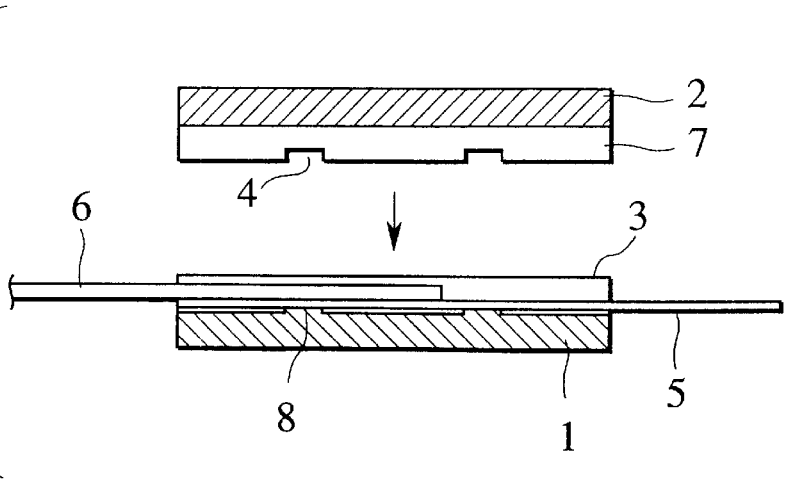
FIG.2 PRIOR ART
FIG. 2 is a cross-sectional view showing a conventionally another connection structure.
Figure 5:
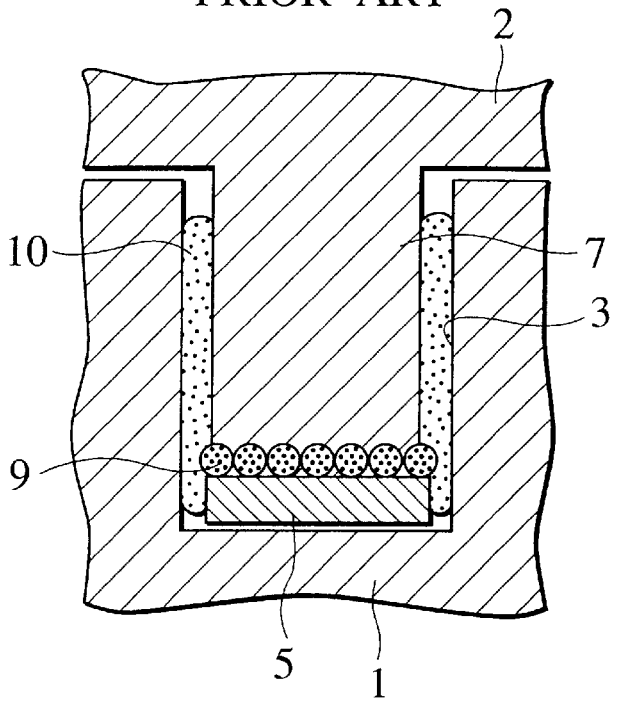
FIG.5 PRIOR ART
FIG. 5 is a cross-sectional view showing a conventionally ideal connective state.
Figure 6:
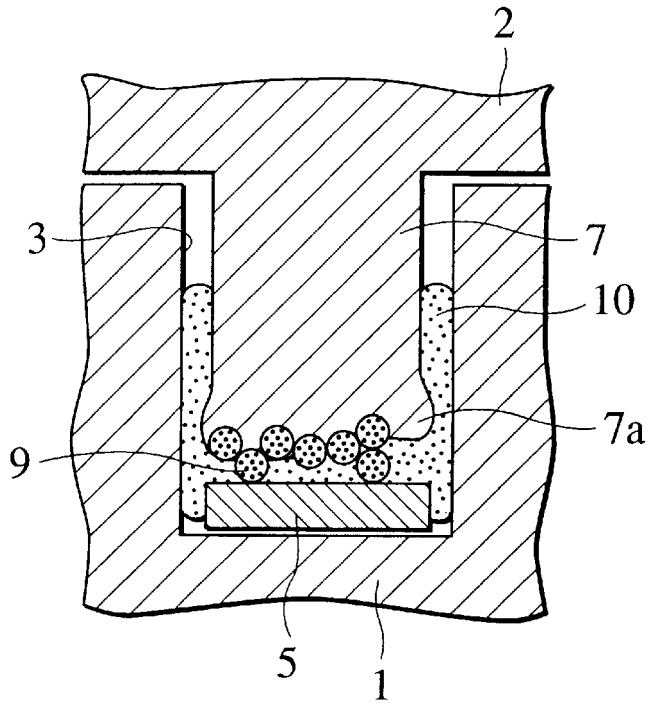
FIG.6 PRIOR ART
FIG. 6 is a cross-sectional view showing a conventionally non-preferable connective state.
Figure 7:
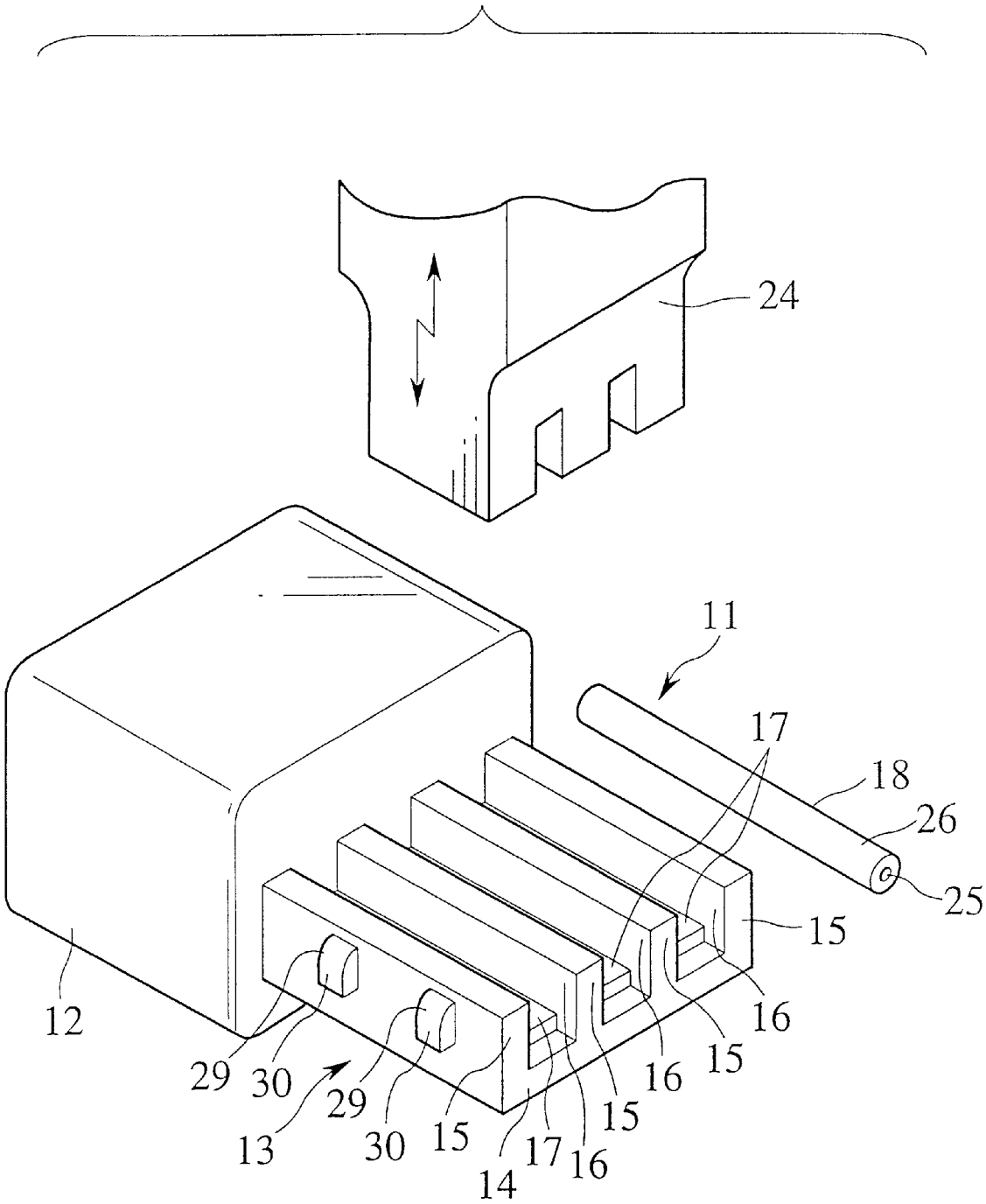
FIG. 7 is a perspective view showing a connector housing in which a covered electric wire and a terminal are connected according to a connecting method of an electric wire and a terminal of one embodiment of the present invention, and showing an ultrasonic applying horn.
Figure 8:
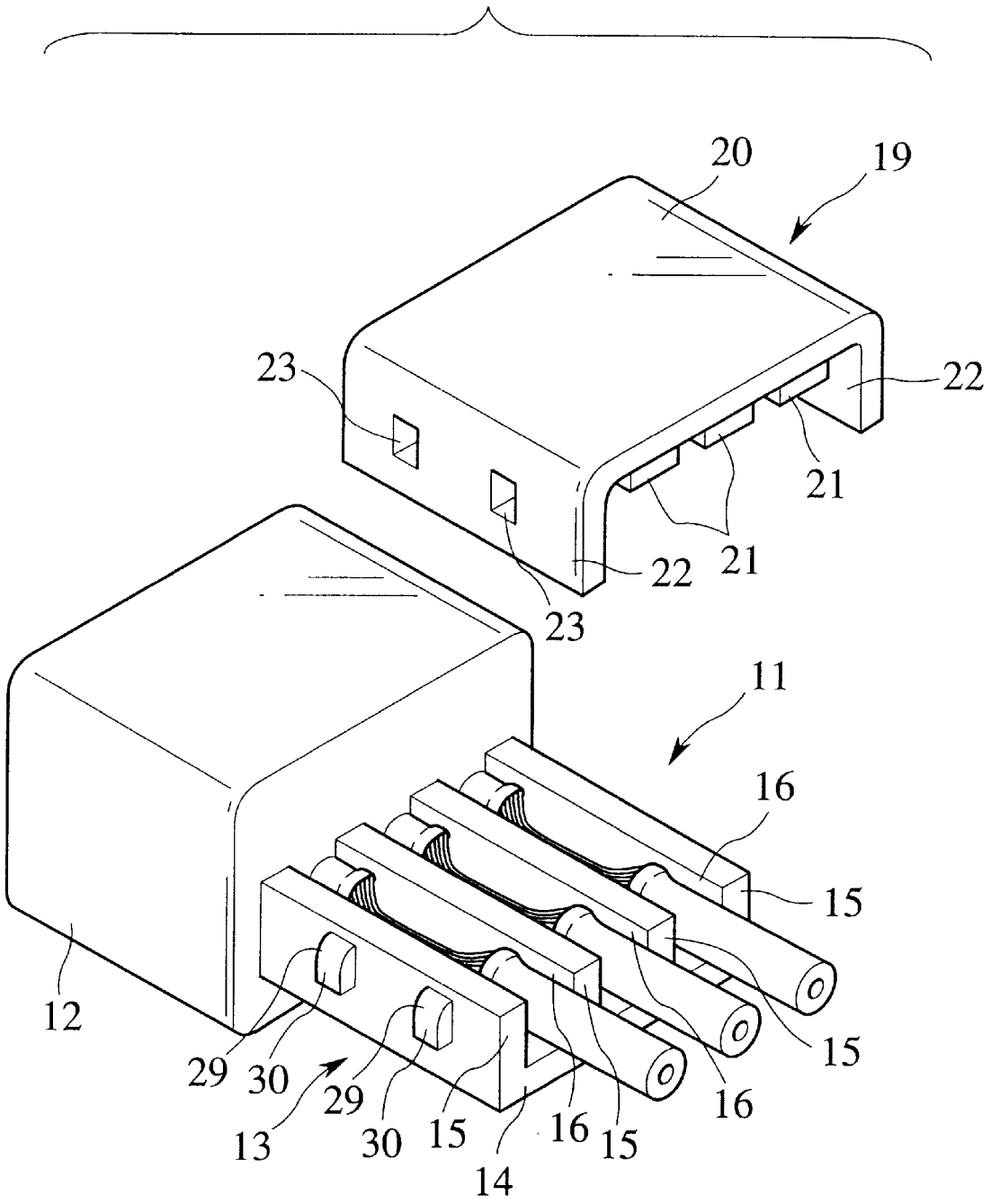
FIG. 8 is an exploded perspective view showing a connector housing in which the covered electric wire and the terminal are connected according to the connecting method of an electric wire and a terminal of one embodiment.

FIG. 7 and FIG. 8 show a connector housing (a first resin member) 11 in which a covered electric wire 18 and a terminal 17 are connected according to the connecting method of an electric wire and a terminal, and an ultrasonic vibration applying horn (electrode) 24. FIG. 8 show the connector housing 11 and a cover (a second resin member) 19 covering an electric-wire leading portion 13 of the connector housing 11.

The connector housing 11 comprises a hood portion 12 which is coupled with a mating connector (not shown) by being fitted thereto, and an electric-wire leading portion 13 which is integrally formed at one side of the hood portion 12.

The electric-wire leading portion 13 has a bottom wall 14 extending from the hood portion 12, a plurality of partition walls 15 which are formed on the upper surface of the bottom wall 14 and are projected in parallel, and a groove portion 16 defined between the partition walls 15. The groove portion 16 has a rectangular shape whose upper portion is opened in its cross section, and the terminal 17 is housed in each groove portion 16 so as to make a connection with the covered electric wire 18. Further, each partition wall 15 on opposite sides are formed with two stopper protrusions 30 and 30 at the outside thereof. These stopper protrusions 30 and 30 are inserted (fitted) into stopper holes 23 of the cover 19 covering the electric-wire leading portion 13.

Figure 11:
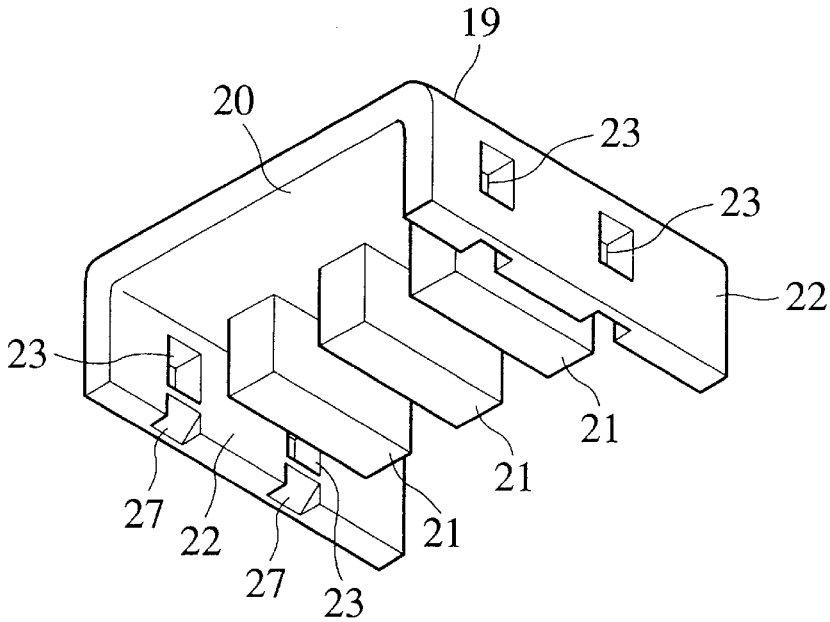
FIG. 11 is a perspective view showing a back side of the cover according to one embodiment.

As shown in FIG. 8 and FIG. 11, the cover 19 includes a cover plate 20 covering the electric-wire leading portion 13, a plurality of protrusions 21 which are formed so as to correspond to the electric-wire leading portion 13 in the cover plate 20, and side wall portions 22 and 22 provided outside the protrusions 21. These side wall portions 22 and 22 are each formed with the aforesaid stopper holes 23 and 23. Further, the lower end portion of these side wall portion 22 and 22 are each formed with partial tapers 27 and 27 corresponding to the stopper holes 23 and 23. The partial taper 27 slides in a state of contacting with an inclined surface 29 of the stopper protrusion 30 so as to relatively guide the stopper protrusion 30 into the stopper hole 23.

The protrusion 21 is formed into the same rectangular shape in its cross section as the groove portion 16 of the electric-wire leading portion 13, and is provided so as to correspond to the groove portion 16. Further, the protrusion 21 is formed so as to have a dimension slightly smaller than the groove portion 16, and is inserted (fitted) into the corresponding groove portion 16 when the cover 19 is put on the electric-wire leading portion 13. When the protrusion 21 is inserted into the groove portion 16, the protrusion 16 contacts with the covered electric wire 18 housed in the groove portion 16 so as to press the covered electric wire 18 against the terminal 17.

One side of the terminal 17 is a contact portion (not shown) which is projected into the hood portion 12 of the connector housing 11 so as to be connected with a mating terminal; the other side thereof is a flat electric-wire contact portion which is housed in the groove portion 16 and is conductively connected with the covered electric wire 18.

Figure 9A:
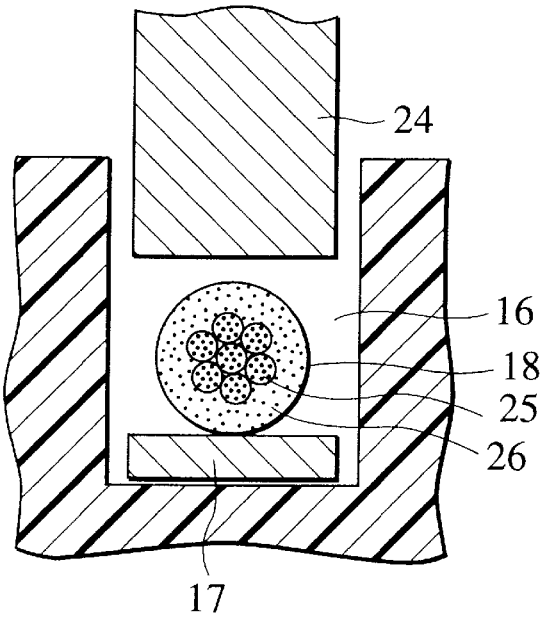
FIGS. 9A, 9B, 9C and 9D show a procedure of the connecting method of the electric wire and the terminal of one embodiment of the present invention.

As shown in FIG. 9A, the covered electric wire 18 is formed in a manner that a plurality of core wires 25 are covered with a covering portion 26 made of an insulative resin such as vinyl chloride or the like.

The following is a description on assembly in this embodiment.

As shown in FIG. 9A, the electric-wire contact portion of the terminal 17 is housed in the groove portion 16 of the connector housing 11, and the contact portion of the mating terminal is projected into the hood portion 12. And then, the covered electric wire 18 is placed on each terminal 17. In this state, the ultrasonic horn 24 is inserted into the groove portion 16, and an ultrasonic vibration or an ultrasonic wave oscillation is applied thereto while pressing the covered electric wire 18 against the terminal 17.

Figure 9B:
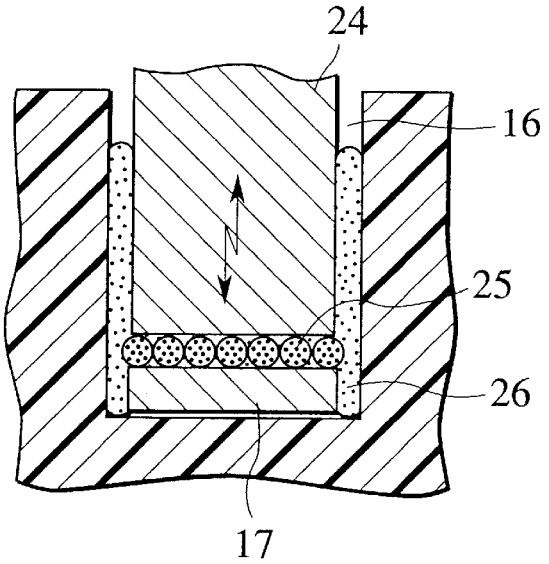

As shown in FIG. 9B, the covering portion 26 of the covered electric wire 18 is exothermic by the ultrasonic vibration, and is melted and removed. And then, by applying a pressure to the core wires 25 from the ultrasonic horn 24, the plurality of core wires 25 are arranged on the terminal in line, that is, in parallel. However, under such circumstances, the core wires 25 is pressed and crushed on the terminal 17 by the pressure from the ultrasonic horn 24, and then, are deformed into an ellipse shape.

Figure 9C:
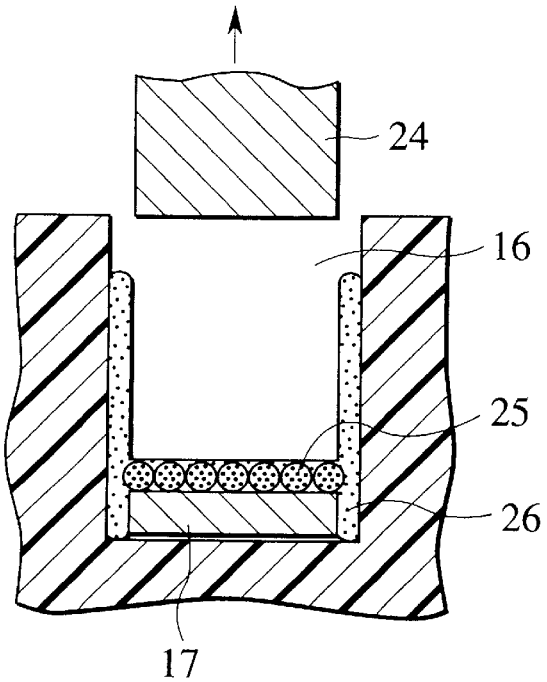
Figure 9D:
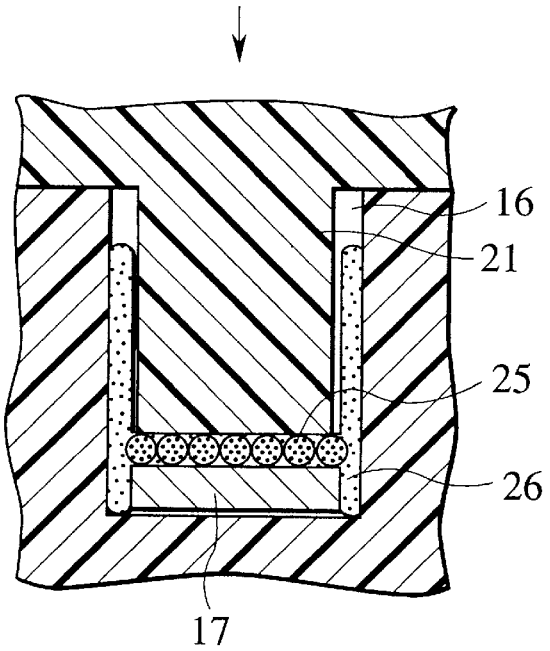
Figure 10:
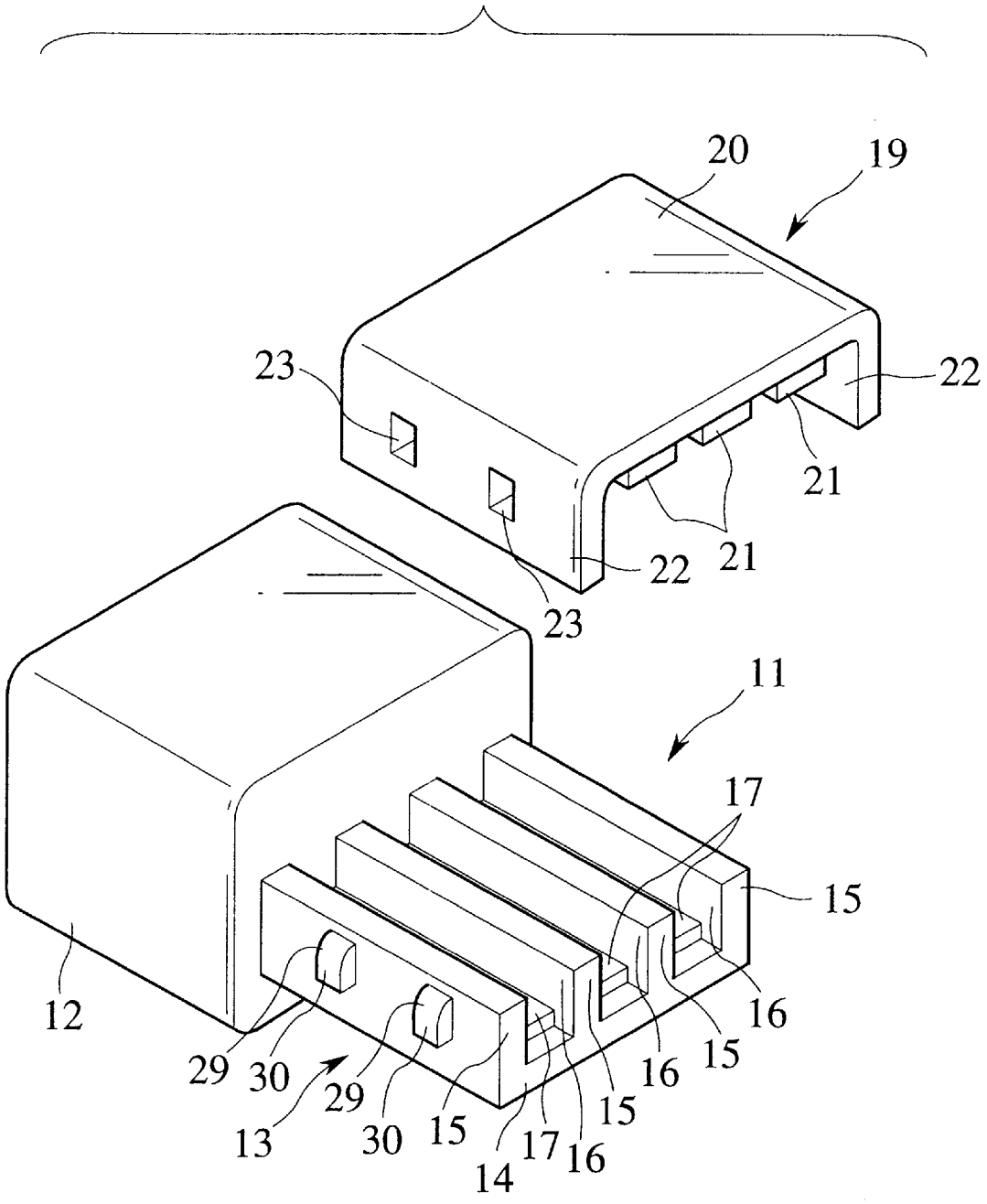
FIG. 10 is an exploded perspective view showing a connector in which the covered electric wire and the terminal are connected according to the connecting method of a electric wire and a terminal of one embodiment of the present invention.

Next, As shown in FIG. 9C, the ultrasonic horn 24 is drawn out from the groove portion 16, and then, as shown in FIG. 9D, the electric-wire leading portion 13 is closed by the cover 19 shown in FIG. 10.

In order to close the electric-wire leading portion 13 by the cover 19, as shown in FIG. 12A, first, the cover 19 is placed on the electric-wire leading portion 13. In this state, the stopper protrusion 30 is not still inserted into the stopper hole 23. Next, as shown in FIG. 12B, both side portions of the cover 19 are pressed down by manually. When the cover 19 is pressed, the stopper protrusion 30 is inserted into the stopper hole 23 so that the cover 19 is fixed on the electric-wire leading portion 13. In this state, the protrusion 21 of the cover 19 is inserted into the groove portion 16, and is abutted against the core wires 25 arranged on the terminal 17, and thus, the core wires 25 are pressed against on the terminal 17.

According to this embodiment, as described above, by the horn 24 for the ultrasonic vibration, the ultrasonic vibration is applied to the terminal 17 and the covered electric wire 18 housed in the groove portion 16 while pressing them. Thus, the core wires 25 of the covered electric wire 18 are arranged in parallel, and in this state, are pressed against the terminal 17 by means of the protrusion 21 of the cover 19. Therefore, the core wires 25 do not come loose, so that a contact area can be sufficiently secured. As a result, a contact resistance can be reduced, and a preferable connection state of the electric wire and the terminal can be obtained.

Further, every core wire 25 is deformed into an elliptic shape by applying a pressure from the horn 24, so that a contact area of the core wires 25 and the terminal 17, and between the core wires 25 can be increased. Whereby a contact resistance can be reduced, and a preferable connection state can be obtained.

In this embodiment, moreover, the partial taper 27 slides in a state of contacting with the inclined surface 29 of the stopper protrusion 30 so as to relatively guide the stopper protrusion 30 into the stopper hole 23.

Next, the following is a description on a modification example shown in FIG. 13. In this modification example, a stopper protrusion 31 and 31 extends upwardly from the intermediate partition wall 15 and 15, and is formed integrally therewith. On the other hand, the cover 19 is formed with a stopper hole 32 and 32 at an intermediate portion of the cover plate 20. The covering portion 26 is melted and removed by means of the ultrasonic horn 24, and the core wires 25 are arranged laterally in line in the groove portion 16. In this state, the cover 19 is placed on the electric-wire leading portion 13, and when pressing the vicinity of the stopper hole 32, the stopper protrusion 31 and 31 is inserted into the stopper hole 32 and 32. In This state, the stopper hole 21 and 21 securely press the core wires 25 against the terminal 17 side.

It is desirable that the connector housing 11 and the cover 19 are meltedly jointed together, instead of the stopper protrusions 30 and the stopper holes 23 in the following manner. First of all, the terminal 17 and the covered electric wire 18 are overlapped in the groove portion 16 of the connector housing 11, and the ultrasonic vibration is applied to them while pressing the same. By doing so, the covering portion 26 of the covered electric wire 18 is melted and removed, and the core wires 25 and the terminal 17 conductively contact with each other, and further, the core wires 25 are arranged on the terminal 17 in a parallel. In this state, the protrusion 21 of the cover 19 is inserted into the groove portion 16 so that the core wires 25 are arranged in parallel on the terminal 17. And then, the connector housing 11 and the cover 19 are coupled with each other by ultrasonic welding, and thereby, it is possible to easily meltedly join the connector housing 11 and the cover 19 together, instead of the stopper protrusions 30 and the stopper holes 23.

While preferred embodiments of the present invention have been described using specific terms, such description is for illustrative purposes, and it is to be understood that changes and variations may be made without departing from the spirit or scope of the following claims.

What is claimed is:

1. A method of connecting an electric wire and a terminal, the electric wire having a plurality of core wires covered with a covering portion made of a resin, the method comprising the steps of:

placing the electric wire on the terminal;

pressing the electric wire against the terminal and directly applying an ultrasonic vibration to the electric wire with an ultrasonic vibration applying horn to melt and remove the covering portion so that the plurality of core wires are arranged on the terminal in a parallel and planar orientation;

pressing the parallelly arranged core wires against the terminal so that the core wires and the terminal conductively contact each other;

removing the horn from the from the wires; and housing the terminal and the electric wire in a groove portion of a first resin member, and inserting a protrusion of a second resin member into the groove portion to press the core wires against the terminal.

2. The method of claim 1, further including the steps of engaging the first resin member and the second resin member so that the protrusion of the second resin member is inserted into the groove portion of the first resin member, and welding the first resin member and the second resin member together.

3. The method of claim 1, further including the steps of mechanically engaging the first resin member and the second resin member so that the protrusion of the second resin member is inserted into the groove portion of the first resin member while pressing the electric wire against the terminal, and welding the first and second resin members together by applying the ultrasonic vibration.

* * * * *

UNITED STATES PATENT AND TRADEMARK OFFICE

CERTIFICATE OF CORRECTION

PATENT NO. : 6,167,616 B1
DATED : January 2, 2001
INVENTOR(S) : Arika Shinchi

It is certified that error appears in the above-identified patent and that said Letters Patent is hereby corrected as shown below:

Claim 1, column 8,
Line 42, before "wires;", delete "from the" (second occurrence).

Signed and Sealed this

Twenty-third Day of October, 2001

*Attest:*

Nicholas P. Godici

NICHOLAS P. GODICI
*Acting Director of the United States Patent and Trademark Office*

*Attesting Officer*